US006453777B1

(12) United States Patent
Newman et al.

(10) Patent No.: US 6,453,777 B1
(45) Date of Patent: Sep. 24, 2002

(54) NON-METALLIC THREE-SECTION EXTENSION POLE HAVING BULB CHANGER

(75) Inventors: Robert D. Newman, 400 Walnut St., P.O. Box 377, Greenwood, MO (US) 64034; Judson C. Cole, Greenwood, MO (US); Buford J. Guittar, Greenwood, MO (US)

(73) Assignees: Robert D. Newman, Greenwood, MO (US); Specialty Products of Greenwood, Missouri, Inc., Greenwood, MO (US)

( * ) Notice: Subject to any disclaimer, the term of this patent is extended or adjusted under 35 U.S.C. 154(b) by 0 days.

(21) Appl. No.: 09/928,184

(22) Filed: Aug. 10, 2001

(51) Int. Cl.[7] ..... B25B 23/16; H01K 3/32

(52) U.S. Cl. ..... 81/53.11; 81/53.1; 294/19.1

(58) Field of Search ..... 81/53.11, 53.1; 49/461; 294/19.1; 403/109.3, 109.5

(56) References Cited

U.S. PATENT DOCUMENTS

| | | | | | |
|---|---|---|---|---|---|
| 1,541,839 | A | * | 6/1925 | Metzler et al. | 81/53.11 |
| 3,101,212 | A | * | 8/1963 | Cater | 81/53.11 |
| 3,101,966 | A | * | 8/1963 | Thomas et al. | 81/53.11 |
| 4,385,849 | A | * | 5/1983 | Crain | 403/109.3 |
| 4,582,352 | A | * | 4/1986 | Filter et al. | 294/19.1 |
| 5,148,723 | A | * | 9/1992 | Newman, Sr. et al. | 81/53.11 |
| 5,220,707 | A | * | 6/1993 | Newman, Sr. et al. | 16/429 |
| 5,593,196 | A | * | 1/1997 | Baum et al. | 294/19.1 |
| 5,765,453 | A | * | 6/1998 | Mims | 81/53.11 |
| 6,045,288 | A | * | 4/2000 | Pasternak et al. | 403/109.3 |
| 6,223,628 | B1 | * | 5/2001 | Barron | 81/53.11 |

* cited by examiner

*Primary Examiner*—Joseph J. Hail, III
*Assistant Examiner*—David B. Thomas
(74) *Attorney, Agent, or Firm*—Hovey Williams LLP

(57) ABSTRACT

An extendable light bulb changing apparatus comprising first, second, and third telescoping sections and a bulb-gripping device coupled to the third section. At least one of the sections is composed of a non-metallic material.

14 Claims, 1 Drawing Sheet

NON-METALLIC THREE-SECTION EXTENSION POLE HAVING BULB CHANGER

BACKGROUND OF THE INVENTION

1. Field of the Invention

The present invention relates generally to extendable poles for use in changing light bulbs. In another aspect, the invention concerns a three-section, non-metallic, extension pole with a bulb-gripping device coupled to an end of the pole.

2. Discussion of Prior Art

Extension poles with bulb-gripping devices have been used for years to change light bulbs in hard-to-reach locations such as, for example, recessed light fixtures in vaulted ceilings. Most conventional extendable bulb-changing devices include two elongated, telescoping sections with a bulb-gripping device attached to the end of one section. The telescoping sections typically have a locking mechanism coupled between them for selectively inhibiting relative telescopic sliding of the two sections. Further, both sections are typically formed with generally circular cross sections. In addition, the telescoping sections of many conventional extendable bulb-changing devices are composed of a metallic material.

Conventional extendable bulb-changing devices employing only two telescoping sections have the limitation of providing a maximum extended reach of only twice the retracted length of the pole. Thus, conventional two-section extension poles having a long reach may be inconvenient to handle and/or store in the retracted position because of their excessive retracted length. Further, the generally circular cross sectional shape of the telescoping sections of a conventional extension pole allow for relative twisting of the sections. This relative twisting can be disadvantageous, particularly when the locking device used to selectively inhibit telescopic sliding of the two sections requires alignment of a shiftable locking pin with apertures in one of the sections. If the two sections are able to be twisted relative to one another, the operator of the pole must take the time to twist the poles back and forth so that the locking pin and the aperture are aligned. Finally, constructing an extendable light bulb changing apparatus out of an electrically conductive metallic material increases the risk of injury to the operator.

OBJECTS AND SUMMARY OF THE INVENTION

Responsive to these and other problems, it is an object of the present invention to provide an extendable bulb-changing apparatus having an extended length which is more than twice its retracted length.

A further object of the present invention is to provide an extendable bulb-changing device having telescoping sections with non-circular cross sections that allow for telescopic sliding of the sections relative to one another, while inhibiting relative twisting of the sections.

A still further object of the present invention is to provide an extendable bulb-changing device that is made of a non-metallic material to thereby minimize the risk of electrical injury to the operator.

It should be noted that the above-listed objects may not all be accomplished by the invention claimed herein and other objects and advantages of this invention will be apparent from the following description of the invention and appended claims.

In one embodiment of the present invention, a three-section, non-metallic extendable light bulb-changing apparatus is provided. The apparatus comprises elongated first, second, and third telescoping sections. The first section defines a first internal channel which at least partly telescopically receives the second section. The second section defines a second internal channel which at least partly telescopically receives the third section. A first locking mechanism is coupled to the first section and is operable to selectively inhibit relative telescopic shifting of the first and second sections. A second locking mechanism is coupled to the second section and is operable to inhibit relative telescopic shifting of the second and third sections. A bulb-gripping device is coupled to the third section and is operable to grip a light bulb.

BRIEF DESCRIPTION OF THE DRAWING FIGURES

Preferred embodiments of the present invention are described in detail below with reference to the attached drawing figures, wherein.

DETAILED DESCRIPTION OF THE PREFERRED EMBODIMENTS

Figures 1, 2, 3:
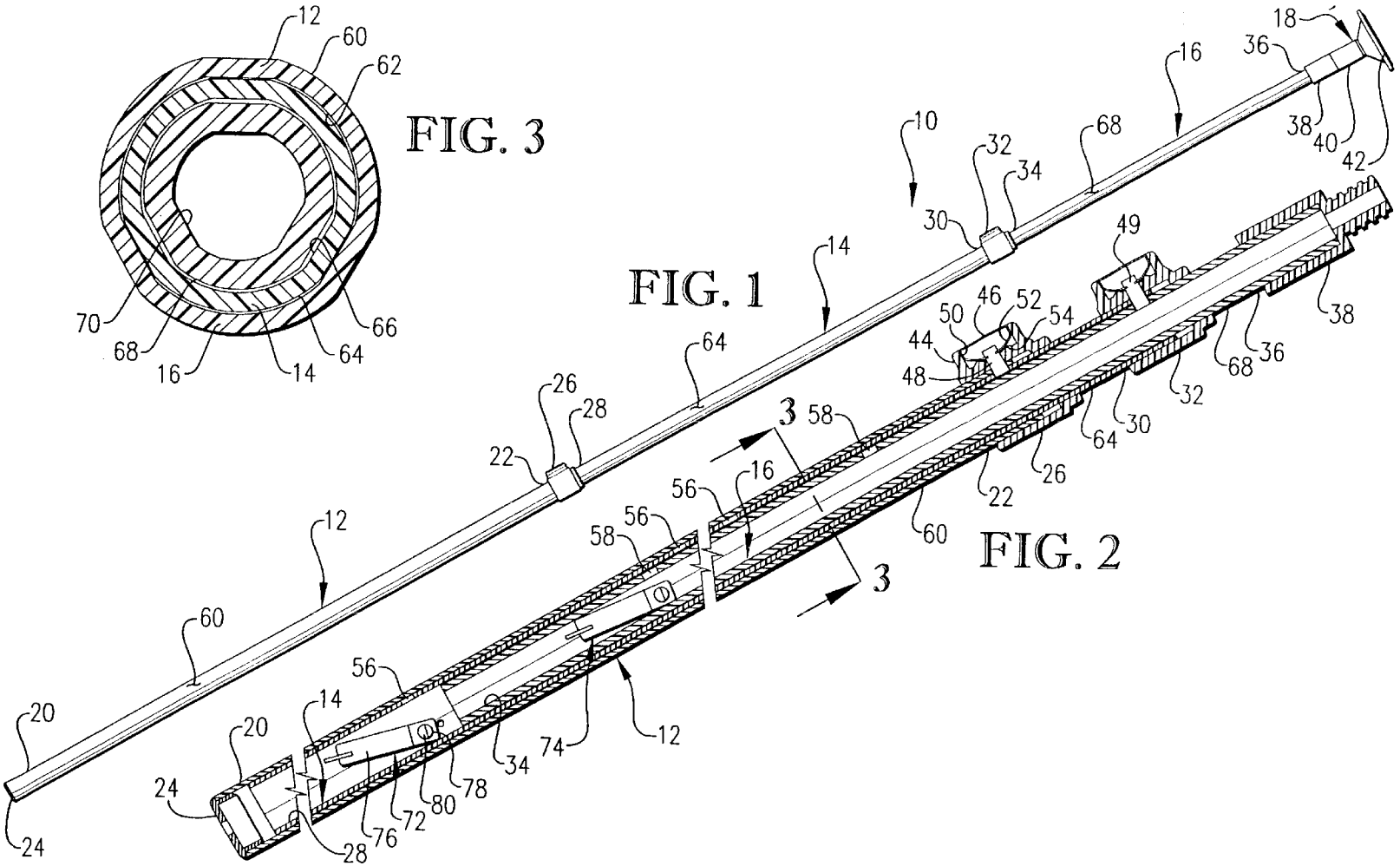
FIG. 1 is a side view of a three-section extendable bulb-changing device in accordance with the present invention, with the device being shown in the extended position.
FIG. 2 is a partial, axial cross sectional view of the extension pole portion of the bulb-changing device shown in FIG. 1, with the extension pole being shown in the retracted position.
FIG. 3 is a cross sectional view taken orthagonally to the longitudinal axis of the extension pole along line 3—3 in FIG. 2, showing the shape of the three telescoping sections.

Referring initially to FIG. 1, extendable bulb-changing device 10 is shown in an extended position. Extendable bulb-changing device 10 generally comprises a first section 12, a second section 14, a third section 16, and a bulb-gripping device 18. First, second, and third sections 12, 14, 16 are generally elongated tubular members of decreasing outer diameter, respectively. First section 12 slidable receives at least a portion of second section 14 in a manner which allows for first and second sections 12, 14 to be telescopically slid relative to one another in an axial direction (i.e., along the longitudinal axes of first and second sections 12, 14). Second section 14 slidably receives at least a portion of third section 16 so that second and third sections 14, 16 can be telescopically slid relative to one another in the axial direction (i.e., along the longitudinal axes of second and third sections 14, 16).

First section 12 presents a first aft end 20 and a first fore end 22. A plug 24 is coupled to first aft end 20 and is operable to prevent the entry of debris into the internal portion of extendable bulb-changing device 10. A first locking mechanism 26 is coupled to first fore end 22. First locking mechanism 26 is operable to selectively inhibit relative axial telescopic sliding of first and second sections 12, 14.

Second section 14 presents a second aft end 28 and a second fore end 30. At least a portion of second aft end 28 is received in first section 12. A second locking mechanism 32 is coupled to second fore end 30 and is operable to selectively inhibit relative axial telescopic sliding of second and third sections 14, 16.

Third section 16 presents a third aft end 34 and a third fore end 36. Third aft end 34 is at least partly received in second section 14. A connector 38 is rigidly coupled to third fore end 36 and is operable to releasably couple bulb-gripping device 18 to third section 16.

Bulb-gripping device 18 generally comprises a coupling portion 40 and a gripping portion 42. Coupling portion 40 preferable includes a female threaded section for threadably receiving a male threaded section of connector 38 to thereby couple bulb-gripping device 18 to third section 16. Gripping portion 42 can comprise any suitable means known in the art for gripping a light bulb in such a manner that the light bulb can be unscrewed from and/or screwed into a light bulb socket. Gripping portion 42 preferably comprises a suction cup capable of gripping a light bulb by vacuum attachment. Most preferably, bulb-gripping device 18 is constructed in accordance with the description in U.S. Pat. No. 5,148,723, issued Sep. 22, 1992, the entire disclosure of which is incorporated herein by reference.

Referring now to FIG. 2, the internal components of the extension pole shown in FIG. 1 are illustrated in greater detail. First and second locking mechanisms 26, 32 have substantially the same configuration and, thus, only first locking mechanism 26 will be described herein, with the understanding that second locking mechanism 32 comprises substantially the same general components. First locking mechanism 26 generally includes a main body 44, a depressible button 46, and a shiftable pin 48. Main body 44 is rigidly coupled to first fore end 22 of first section 12. Main body 44 defines a cavity 50 within which depressible button 46 is at least partly received. Depressible button 46 includes a bottom resilient member 52 coupled to shiftable pin 48 and resting on a ridge 54 defined by main body 44. Shiftable pin 48 extends through main body 44, a hole in first section 12, and can be selectively received in any one of a plurality of axially spaced second member holes 56 formed in second section 14.

Second locking mechanism 32 provides the same function as first locking mechanism 26, however it does so with respect to second and third sections 14,16 rather than first and second sections 12, 14. A shiftable pin 49 of second locking mechanism 32 can be selectively received in axially spaced third member holes 58 formed in third section 16. First and second locking mechanisms 26, 32 are preferably constructed in accordance with the description in U.S. Pat. No. 5,220,707, issued Jun. 22, 1993, the entire disclosure of which is incorporated herein by reference.

In operation, when depressable button 46 is depressed, an outer portion of resilient member 52 is forced downward. This downward movement of the outer portion of resilient member 52 causes an inner portion of resilient member 52 to be raised via pivoting of resilient member 52 on ridge 54. The inner portion of resilient member 52 is coupled to shiftable pin 48 so that when button 46 is depressed, pin 48 is raised out of a respective first member hole 56. When button 46 is released, resilient member 52, which biases shiftable pin 48 towards its normal inserted position (shown in FIG. 2), forces shiftable pin 48 into a respective first member hole 56. Thus, the relative axial position of first and second sections 12, 14 can be readily adjusted.

The extension pole shown in FIG. 2 further includes a pair of stop mechanisms 72, 74 operable to prevent decoupling and separation of sections 12, 14, 16 when the extension pole is in the extended position. Because stop mechanisms 72, 74 are substantially similar in design and function, only stop mechanism 72 will be described herein, with the understanding that stop mechanism 74 includes substantially the same components and performs substantially the same operation with respect to second and third sections 14, 16. Stop mechanism 72 generally includes a V-shaped resilient body 76 and a pair of protrusions 78 extending outwardly from the respective diverging ends of the body 76. Body 76 is configured to be yieldably flexed to thereby bias protrusions 78 outwardly so that protrusions 78 remain in respective openings (not shown) in second section 14 at all times. When second section 14 is telescopically slid a maximum distance out of first section 12, protrusions 78 are pushed further outward by body 76 and snap into corresponding openings (not shown) in first section 12 to thereby prevent the separation of first and second sections 12, 14. Protrusions 78 each include a sloped surface 80 which allows for protrusions 78 to be automatically retracted from the holes in first section 12 via a camming action when second section 14 is retracted back into first section 12.

Referring now to FIGS. 1–3, first section 12 presents a first outer surface 60 and a first inner surface 62, each extending axially between first aft end 20 and first fore end 22. First inner surface 62 at least partly defines a first internal channel in which second section 14 is telescopically received. Second section 14 presents a second outer surface 64 and a second inner surface 66, each extending axially between second aft end 28 and second fore end 30. Second inner surface 66 at least partly defines a second internal channel in which third section 16 is telescopically received. Third section 16 presents a third outer surface 68 and a third inner surface 70, each extending axially between third aft end 34 and third fore end 36.

As best seen in FIG. 3, the shapes of inner and outer surfaces 60–70 are noncircular when viewed from an orthogonal cross section (in FIG. 3). As used herein, the term "orthogonal cross section" shall mean a cross section of at least one of the sections 12, 14, 16 taken orthogonally to the longitudinal axis of that respective section. As can be seen in FIG. 3, each of surfaces 60–70 are generally tri-oval in shape when viewed from an orthogonal cross section. As used herein, the term "tri-oval" shall mean a shape that is generally circular with the exception of three substantially flat portions symmetrically spaced about the circle. Thus, each of surfaces 60–70 includes three substantially flat portions. The flat portions of first inner surface 62 and second outer surface 64 are juxtapositioned so that relative axial telescopic sliding of first and second sections 12, 14 is permitted while relative twisting of first and second sections 12, 14 is inhibited due to the non-circular interface between first inner surface 62 and second outer surface 64. The flat portions of second inner surface 66 and third outer surface 68 are juxtapositioned so that relative axial telescopic sliding of second and third sections 14, 16 is permitted while relative twisting of second and third sections 14, 16 is inhibited due to the non-circular interface between second internal surface 66 and third outer surface 68.

Because relative twisting on the longitudinal axes of sections 12, 14, 16 is inhibited by the shape of sections 12, 14,16, first member holes 56 and second member holes are maintained in alignment with shiftable pins 48, 49 so that no twisting of sections 12, 14, 16 is required to lock sections 12, 14, 16 relative to one another.

The material of construction of sections 12, 14, 16, as well as locking mechanisms 26,32 and bulb-gripping device 18, is preferably a non-metallic, non-electrically conductive material. Most preferably, sections 12, 14, 16 are composed of a substantially rigid and durable synthetic resin material.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. An extendable apparatus for changing light bulbs, said apparatus comprising:

an elongated first section defining a first internal channel;

an elongated second section at least partly telescopically received in the first internal channel, said second section defining a second internal channel;

a first locking mechanism coupled to the first section and operable to selectively inhibit relative telescopic shifting of the first and second sections;

a second locking mechanism coupled to the second section and operable to selectively inhibit relative telescopic shifting of the second and third sections;

a bulb-gripping device coupled to the third section and operable to grip a light bulb, at least one of said sections being composed of a non-metallic material; and a stop mechanism coupled to the second section and operable to prevent separation of the first and second sections, said stop mechanism including a generally V-shaped resilient body and a pair of protrusions extending outwardly from respective diverging ends of the resilient body.

2. An apparatus according to claim 1, said first section presenting a first fore end, a first aft end, and a first inner surface extending axially between the first ends, said first inner surface defining at least a portion of the first internal channel and having a generally non-circular shape when viewed from an orthagonal cross section of the first section.

3. An apparatus according to claim 2, said second section presenting a second fore end, a second aft end, a second inner surface, and a second outer surface, said second surfaces extending axially between the second ends, said second inner surface defining at least a portion of the second internal channel, said second surfaces having generally noncircular shapes when viewed from an orthogonal cross section of the second section.

4. An apparatus according to claim 3, said first internal surface and said second outer surface having generally corresponding non-circular shapes which allow for the first and second sections to slide axially relative to one another while restricting relative twisting of the first and second sections.

5. An apparatus according to claim 4, said third section presenting a third fore end, a third aft end, and a third outer surface extending axially between the third ends, said third outer surface having a generally non-circular shape when viewed from an orthogonal cross section of the third section.

6. An apparatus according to claim 5, said second inner surface and said third outer surface having generally corresponding non-circular shapes which allow for the second and third sections to slide axially relative to one another while restricting relative twisting of the second and third sections.

7. An apparatus according to claim 6, said first inner surface, said second outer surface, said second inner surface, and said third outer surface each presenting a respective axially extending, at least substantially flat portion.

8. An apparatus according to claim 7, said flat portions of the second and third outer surfaces including a second and third group of axially spaced holes, respectively.

9. An apparatus according to claim 8, said first and second locking mechanisms coupled to the first fore end and the second fore end, respectively.

10. An apparatus according to claim 9, said first and second locking mechanisms each including a depressable button and a protruding pin, said protruding pin of said first locking mechanism operable to be selectively received in and removed from any of the holes of said second group of axially spaced holes, said protruding pin of said second locking mechanism operable to be selectively received in and removed from any of the holes of said third group of axially spaced holes.

11. An apparatus according to claim 6, said first inner surface, said second outer surface, said second inner surface, and said third outer surface each having a generally tri-oval shape when viewed from an orthogonal cross section of the respective sections.

12. An appartatus according to claim 1, said section composed of a non-conductive material.

13. An apparatus according to claim 1, said sections composed of a non-metallic material.

14. An apparatus according to claim 1, said bulb-gripping device comprising a suction cup.

* * * * *